US011339811B2

(12) United States Patent
Stefani et al.

(10) Patent No.: US 11,339,811 B2
(45) Date of Patent: May 24, 2022

(54) HYDRAULIC CIRCUIT

(71) Applicant: DANA ITALIA S.R.L., Arco (IT)

(72) Inventors: Matteo Stefani, Rubiera (IT); Nicola Francesco Musciagna, San Giovanni in Persiceto (IT); Alessandro Sassi, Reggio Emilia (IT); Lorenzo Serrao, Torbole sul Garda (IT)

(73) Assignee: DANA ITALIA S.R.L., Arco (IT)

( * ) Notice: Subject to any disclaimer, the term of this patent is extended or adjusted under 35 U.S.C. 154(b) by 0 days.

(21) Appl. No.: 17/251,590

(22) PCT Filed: Jun. 14, 2019

(86) PCT No.: PCT/EP2019/065736
§ 371 (c)(1),
(2) Date: Dec. 11, 2020

(87) PCT Pub. No.: WO2019/238946
PCT Pub. Date: Dec. 19, 2019

(65) Prior Publication Data
US 2021/0254642 A1 Aug. 19, 2021

(51) Int. Cl.
*F15B 21/14* (2006.01)
*E02F 9/22* (2006.01)
(Continued)

(52) U.S. Cl.
CPC ..... *F15B 21/14* (2013.01); *E02F 9/2217* (2013.01); *E02F 9/2292* (2013.01);
(Continued)

(58) Field of Classification Search
None
See application file for complete search history.

(56) References Cited

U.S. PATENT DOCUMENTS 6,460,332 B1 * 10/2002 Maruta ..... E02F 9/2217 60/414
6,989,640 B2 * 1/2006 Yoshimatsu ..... E02F 9/2217 318/34
(Continued)

FOREIGN PATENT DOCUMENTS

CN 101691878 A 4/2010
CN 106015137 A 10/2016
(Continued)

OTHER PUBLICATIONS

European Patent Office, Extended European Search Report Issued in Application No. 18425043.9, dated Jan. 23, 2019, Germany, 9 pages.
(Continued)

*Primary Examiner* — Michael Leslie
(74) *Attorney, Agent, or Firm* — McCoy Russell LLP

(57) ABSTRACT

The present disclosure relates to a hydraulic circuit, comprising: a hydraulic displacement unit for driving an implement; a hydraulic machine fluidly connected or selectively fluidly connected with the hydraulic displacement unit the hydraulic machine having a fixed hydraulic displacement; an electric machine drivingly engaged or selectively drivingly engaged with the hydraulic machine; a hydraulic pump fluidly connected or selectively fluidly connected with the hydraulic displacement unit, the hydraulic pump having a variable hydraulic displacement; and an electric motor drivingly engaged or selectively drivingly engaged with the hydraulic pump.

16 Claims, 9 Drawing Sheets

(51) Int. Cl.
*F15B 11/17* (2006.01)
*F15B 11/16* (2006.01)

(52) U.S. Cl.
CPC ..... *E02F 9/2296* (2013.01); *F15B 11/165* (2013.01); *F15B 11/17* (2013.01); *F15B 2211/20515* (2013.01); *F15B 2211/20538* (2013.01); *F15B 2211/20546* (2013.01); *F15B 2211/20569* (2013.01); *F15B 2211/26* (2013.01); *F15B 2211/2658* (2013.01); *F15B 2211/3058* (2013.01); *F15B 2211/625* (2013.01); *F15B 2211/6326* (2013.01); *F15B 2211/88* (2013.01)

(56) References Cited

U.S. PATENT DOCUMENTS 7,565,801 B2 * 7/2009 Tozawa ..... E02F 9/2075 60/414
7,634,911 B2 12/2009 Brinkman
7,770,697 B2 * 8/2010 Futahashi ..... F15B 21/14 187/224
10,968,603 B2 * 4/2021 Stenlund ..... E02F 9/2296
2005/0246082 A1 * 11/2005 Miki ..... E02F 9/2217 701/50
2009/0288408 A1 * 11/2009 Tozawa ..... F15B 21/14 60/435
2012/0023924 A1 * 2/2012 Clark ..... F15B 11/17 60/484

FOREIGN PATENT DOCUMENTS

DE 102016217541 A1 3/2018
GB 2465572 A 5/2010
JP 2013045438 A 3/2013

OTHER PUBLICATIONS

ISA European Patent Office, International Search Repod and Written Opinion Issued in Application No. PCT/EP2019/065736, dated Sep. 20, 2019, WIPO, 13 pages.

* cited by examiner

HYDRAULIC CIRCUIT

CROSS-REFERENCE TO RELATED APPLICATIONS

The present application is a U.S. National Phase of International Patent Application No. PCT/EP2019/065736, entitled "HYDRAULIC CIRCUIT", and filed on Jun. 14, 2019. International Patent Application No. PCT/EP2019/065736 claims priority to European Patent Application No. 18425043.9, entitled "HYDRAULIC CIRCUIT", and filed on Jun. 15, 2018. The entire contents of each of the above-mentioned applications are hereby incorporated by reference in their entirety for all purposes.

TECHNICAL FIELD

The present disclosure relates to hydraulic circuits, in particular to electrically driven hydraulic circuits. Hydraulic circuits of the presently proposed type may find application for driving hydraulic implements, for example on working machines or working vehicles such as teleboom handlers, loaders, dumpers, fork lift trucks, tractors, or the like.

BACKGROUND AND SUMMARY

Known working machines or working vehicles are typically equipped with one or more hydraulically driven implements such as hydraulic pumps, hydraulic motors, or hydraulic cylinders. For example, a boom handler may include at least one hydraulic cylinder for lifting and lowering a boom. In practice, the hydraulic implements on a working machine may be used for handling loads having a wide range of different weights. Furthermore, the hydraulic implements of a working machine may be operated using a wide range of different flow rates. Also, depending on the situation their operation may require varying degrees of precision. In all of these cases, the hydraulic implements should be operated in an energy efficient manner.

Thus, the problem addressed by the present disclosure consists of designing a hydraulic circuit including a hydraulic actuator or hydraulic displacement unit which allows operating the hydraulic actuator in an efficient manner in a large number of situations.

This problem is solved by a hydraulic circuit as described herein.

The presently proposed hydraulic circuit includes a hydraulic displacement unit for driving an implement; a hydraulic machine fluidly connected or selectively fluidly connected with the hydraulic displacement unit, the hydraulic machine having a fixed hydraulic displacement; an electric machine drivingly engaged or selectively drivingly engaged with the hydraulic machine; a hydraulic pump fluidly connected or selectively fluidly connected with the hydraulic displacement unit, the hydraulic pump having a variable hydraulic displacement; and an electric motor drivingly engaged or selectively drivingly engaged with the hydraulic pump.

Fixed displacement pumps typically operate efficiently and reliably at high speeds and at high flow rates. However, at low speeds the flow rate provided by a fixed displacement pump can often not be regulated with a sufficiently high degree of precision which may entail inefficiencies. The presently proposed hydraulic circuit addresses these shortcoming by providing a hydraulic displacement unit such as a hydraulic cylinder or a hydraulic motor which may be connected to both a fixed displacement hydraulic machine and to a variable displacement hydraulic pump, wherein the fixed displacement hydraulic machine and the variable displacement hydraulic pump may be driven by separate power sources, for example by an electric machine and by an electric motor, respectively. At low flow rates variable displacement hydraulic pumps may typically be operated more precisely and more efficiently. Thus, depending on the requested flow rate the hydraulic displacement unit may be selectively driven by the variable displacement hydraulic pump and/or by the fixed displacement hydraulic machine. In this way, the hydraulic displacement unit may be operated at a high degree of efficiency for a variety of different flow rates.

The hydraulic circuit may further comprise a control unit configured to control the electric machine and the electric motor, in particular at least one or more of a rotational speed of the electric machine, a power of the electric machine, a rotational speed of the electric motor, and a power of the electric motor. The control unit typically comprises electric circuitry. The control unit may comprise a processing unit such as a microprocessor, a programmable FPGA, or the like.

For example, the control unit may be configured to control the electric machine and the electric motor based on a requested flow rate through the hydraulic displacement unit and based on a threshold flow rate through the hydraulic displacement unit. For instance, the hydraulic circuit may comprise an input device in communication with the control unit, for example through a wired or wireless connection. The input device may comprise at least one of a knob, a switch, a pedal, a lever, or a touch screen. An operator may then input the requested flow rate by means of the input device. For example, the value of the threshold flow rate may depend on at least one or more parameters such as on one or more of a hydraulic displacement of the electric machine, a maximum hydraulic displacement of the hydraulic pump, a maximum power of the electric machine, a maximum power of the electric motor, and the requested flow rate. For example, the control unit may be configured to determine or to calculate the threshold flow rate based on one or more of these parameters. The threshold flow rate may also have a predetermined value.

The control unit may be configured to halt the electric machine and to drive the hydraulic displacement unit via the electric motor and the hydraulic pump if the requested flow rate is below the threshold flow rate.

Additionally or alternatively, if the requested flow rate is equal to or above the threshold flow rate, the control unit may be configured to halt the electric machine and to drive the hydraulic displacement unit via the electric motor and the hydraulic pump at least as long as an actual flow rate through the hydraulic displacement unit is below the threshold flow rate. In this case the control unit may further be configured to drive the hydraulic displacement unit via the electric machine and the hydraulic machine when or once the actual flow rate exceeds the threshold flow rate. Also, if the requested flow rate is equal to or above the threshold flow rate the control unit may further be configured to halt the electric motor when or once the actual flow rate exceeds the threshold flow rate.

The control unit may further be configured to control the hydraulic displacement of the variable displacement hydraulic pump, for example based on at least one of the requested flow rate through the hydraulic displacement unit and the actual flow rate through the hydraulic displacement unit. For instance, the hydraulic pump may include a movable swashplate for varying the hydraulic displacement of the hydraulic pump. The control unit may then be configured to control a swivel angle of the movable swashplate, for example by means of a hydraulic actuator or by means of an electric actuator.

The hydraulic circuit may further comprise an energy storage device such as a battery, the energy storage device being electrically connected with the electric machine. For example, the electric machine and the hydraulic machine may be configured to be operated in a drive mode for driving the hydraulic displacement unit. In the drive mode, the electric machine is operated as an electric motor converting energy stored in the energy storage device into mechanical energy for driving the hydraulic machine and the hydraulic machine is operated as a hydraulic pump for pressurizing the hydraulic displacement unit.

The energy storage device may comprise a rechargeable energy storage device such as an accumulator. For example, the rechargeable energy storage device may comprise one or more electric capacitors or one or more rechargeable batteries. The electric machine and the hydraulic machine may then be configured to be operated in a recuperation mode for recuperating energy from the hydraulic displacement unit or via the hydraulic displacement unit, and for transferring the recuperated energy to the rechargeable energy storage device for storing the recuperated energy in the rechargeable energy storage device. In the recuperation mode the hydraulic machine is operated as a hydraulic motor for driving the electric machine, and the electric machine is operated as a generator for charging the energy storage device. For example, in the recuperation mode a load acting on the hydraulic displacement unit may cause displacement of fluid from the hydraulic displacement unit to the hydraulic machine, thereby driving the hydraulic machine.

The energy storage device or the rechargeable energy storage device may further be electrically connected with the electric motor for driving the electric motor.

Typically, the hydraulic displacement unit comprises a first fluid port and a second fluid port. The hydraulic machine may be selectively fluidly connected with the first fluid port of the hydraulic displacement unit, for example through one or more valves. Specifically, the hydraulic machine may be selectively fluidly connected with the first fluid port of the hydraulic displacement unit via either one of a first fluid line for pressurizing the hydraulic displacement unit via the first fluid line, and a second fluid line for recuperating energy from or via the hydraulic displacement unit via the second fluid line.

For example, when the electric machine and the hydraulic machine are operated in the drive mode, the hydraulic machine may be fluidly connected with the first fluid port of the hydraulic displacement unit via the first fluid line. And when the electric machine and the hydraulic machine are operated in the recuperation mode, the hydraulic machine may be fluidly connected with the first fluid port of the hydraulic displacement unit via the second fluid line. The hydraulic circuit may comprise a first valve for selectively blocking a flow of fluid between the hydraulic machine and the hydraulic displacement unit through the first fluid line, and the hydraulic circuit may comprise a second valve for selectively blocking a flow of fluid between the hydraulic machine and the hydraulic displacement unit through the second fluid line. For example, the above-described control unit may be configured to control the first valve and/or the second valve.

The hydraulic pump may be selectively fluidly connected with either one of the first fluid port of the hydraulic displacement unit and the second fluid port of the hydraulic displacement unit. In other words, the hydraulic pump may be used to selectively pressurize either one of the first fluid port and the second fluid port of the hydraulic displacement unit. This way, the variable displacement hydraulic pump may selectively move or drive a movable member of the hydraulic displacement unit such as a hydraulic piston both in a first direction and in a second direction opposite the first direction.

For example, the hydraulic pump may be selectively fluidly connected with either one of the first fluid port of the hydraulic displacement unit and the second fluid port of the hydraulic displacement unit through a control valve. This control valve may include at least: a first fluid port fluidly connected or selectively fluidly connected with the hydraulic pump and with the hydraulic machine, in particular through the above-described first fluid line; a second fluid port fluidly connected with the first fluid port of the hydraulic displacement unit and with the hydraulic machine, in particular through the above-described second fluid line; and a third fluid port fluidly connected or selectively fluidly connected with the second fluid port of the hydraulic displacement unit. The control valve may have at least a first control position in which the first fluid port of the control valve is fluidly connected with the second fluid port of the control valve and fluidly isolated from the third fluid port of the control valve, and a second control position in which the first fluid port of the control valve is fluidly connected with the third fluid port of the control valve and fluidly isolated from the second fluid port of the control valve. The above-described control unit may be configured to control the control valve. In particular, the control unit may be configured to switch the control valve between the first control position and the second control position.

The first fluid port of the hydraulic displacement unit and the second fluid port of the hydraulic displacement unit may be in selective fluid communication with one another via a one-way valve. For example, the one way valve may be connected with the first and the second fluid port of the hydraulic displacement unit in such a way that the one-way valve permits a flow of fluid through the one-way valve from the second fluid port of the hydraulic displacement unit to the first fluid port of the hydraulic displacement unit, and to block a flow of fluid through the one-way valve from the first fluid port of the hydraulic displacement unit to the second fluid port of the hydraulic displacement unit.

Additionally, a further hydraulic circuit is presently proposed. This further hydraulic circuit includes at least: at least one steering cylinder; at least one brake cylinder; at least one heat exchanger, in particular a cooler for cooling a lubrication system; and a further hydraulic pump drivingly engaged or selectively drivingly engaged with a further electric motor; wherein the further hydraulic pump is fluidly connected or selectively fluidly connected with the at least one steering cylinder, with the at least one brake cylinder, and with the at least one heat exchanger.

The further hydraulic circuit may be combined with the previously described hydraulic circuit. For example, the further electric motor of the further hydraulic circuit may be replaced by the electric motor of the previously described hydraulic circuit. Or in other words, the electric motor of the previously described hydraulic circuit may additionally be drivingly engaged or selectively drivingly engaged with the further hydraulic pump of the further hydraulic circuit.

BRIEF DESCRIPTION OF THE FIGURES

Embodiments of the presently proposed hydraulic circuits are described in the following detailed description and depicted in the accompanying drawing in which.

DETAILED DESCRIPTION

Figure 1:
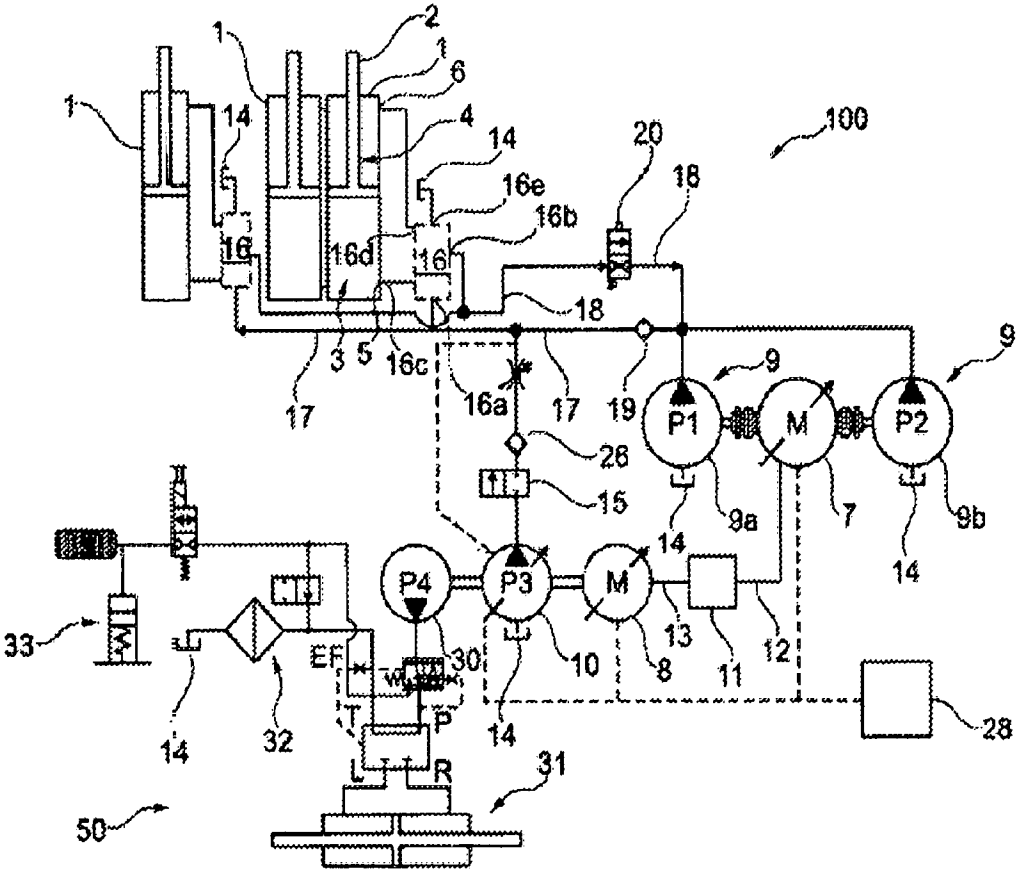
FIG. 1 schematically shows the presently proposed hydraulic circuit according to a first embodiment.

FIG. 1 schematically shows an embodiment of a hydraulic circuit 100 of the presently proposed type which may be disposed in a working machine such as a boom handler, for example. The hydraulic circuit 100 comprises three identical hydraulic displacement units 1. It is understood that in alternative embodiments the hydraulic displacement units 1 may not be identical or that the hydraulic circuit 100 may comprise a smaller or a larger number of hydraulic displacement units. For simplicity, in the following only one of the three identical hydraulic displacement units 1 is described in detail. In FIG. 1 the hydraulic displacement units 1 are configured as hydraulic cylinders which may be part of a lifting mechanism, for example. However, it is understood that in alternative embodiments the hydraulic displacement units 1 may include hydraulic motors or other types of hydraulic displacement units.

In FIG. 1 each of the hydraulic displacement units 1 comprises a movable piston 2 dividing the corresponding cylinder into a first fluid chamber 3 and into a second fluid chamber 4. For lifting a load supported by the piston 2, the piston 2 may be moved upward by pressurizing the first fluid chamber 3. And for lowering a load supported by the piston 2, the piston 2 may be moved downward by de-pressurizing the first fluid chamber 3 and/or by pressurizing the second fluid chamber 4. Fluid communication with the first fluid chamber 3 is provided via a first fluid port 5, and fluid communication with the second fluid chamber 4 is provided via a second fluid port 6. The hydraulic circuit 100 further comprises an electric machine 7 which includes an electric motor/generator, and an electric motor 8. In other words, the electric machine 7 may be selectively operated either as an electric motor or as an electric generator. The electric machine 7 is in driving engagement with a hydraulic machine 9 comprising a hydraulic pump/motor 9*a* and a hydraulic pump/motor 9*b*, and the electric motor 8 is in driving engagement with a hydraulic pump 10. It is understood that in alternative embodiments the hydraulic machine 9 may comprise only one hydraulic pump/motor or more than two hydraulic pumps/motors. The hydraulic pumps/motors 9*a*, 9*b* may be coupled to the electric machine 7 via the same drive shaft so that the pumps/motors 9*a*, 9*b* always rotate at the same speed. The hydraulic pumps/motors 9*a*, 9*b* each have a fixed hydraulic displacement, whereas the hydraulic pump 10 has a variable hydraulic displacement. For example, the hydraulic pump 10 may include a movable swashplate so that the hydraulic displacement of the hydraulic pump 10 may be changed by changing a swivel angle of the swashplate. The fixed hydraulic displacement of the hydraulic machine 9 including the hydraulic pumps/motors 9*a*, 9*b* may be bigger than a maximum hydraulic displacement of the variable hydraulic displacement pump 10, for example.

The hydraulic circuit 100 further comprises an energy storage device 11 electrically connected with the electric machine 7 and with the electric motor 8 via electric connections 12, 13. The energy storage device 11 is a rechargeable energy storage device. For example, the energy storage device 11 may include one or more electric capacitors, one or more rechargeable batteries or other rechargeable energy storage devices.

The electric motor 8 may be powered by energy stored in the energy storage device 11. That is, the electric motor 8 may convert energy stored in the energy storage device 11, in particular electrical energy or electrochemical energy, into mechanical energy for driving the hydraulic pump 10. Similarly, when the electric machine 7 is operated as an electric motor the electric machine 7 may convert energy stored in the energy storage device 11, in particular electrical energy or electrochemical energy, into mechanical energy for driving the hydraulic machine 9 including the hydraulic pumps/motors 9*a*, 9*b*. Additionally, when the electric machine 7 is operated as an electric generator the electric machine 7 may convert mechanical energy into electrical energy which may then be transmitted to and stored in the energy storage device 11, for example in electrical or in electrochemical form.

The variable displacement hydraulic pump 10 is in fluid communication with a low pressure fluid tank 14. Additionally, the variable displacement hydraulic pump 10 is selectively fluidly connected with the hydraulic displacement unit 1. More specifically, the variable displacement hydraulic pump 10 is selectively fluidly connected with the fluid ports 5, 6 of the hydraulic displacement unit 1 via a solenoid controlled 2/2-way valve 15 and via a valve assembly 16. Furthermore, a one-way valve 26 blocks a flow of fluid from the hydraulic machine 9 to the hydraulic pump 10 through the fluid line 17. The valve assembly 16 is depicted in more detail in FIG. 2. Here and in all of the following recurring features depicted in different figures are designated with the same reference signs.

Similarly, the hydraulic pumps/motors 9*a*, 9*b* of the hydraulic machine 9 are in fluid communication with the fluid tank 14. Additionally, the hydraulic pumps/motors 9*a*, 9*b* are selectively fluidly connected with the hydraulic displacement unit 1. More specifically, the hydraulic pumps/motors 9*a*, 9*b* are selectively fluidly connected with the fluid ports 5, 6 of the hydraulic displacement unit 1 via a first fluid line 17, a second fluid line 18 and via the valve assembly 16 depicted in FIG. 2.

A one-way valve 19 selectively blocks a flow of fluid between the hydraulic machine 9 and the hydraulic displacement unit 1, more specifically between the hydraulic machine 9 and the valve assembly 16, through the first fluid line 17. More specifically, the one-way valve 19 permits a flow of fluid from the hydraulic pumps/motors 9*a*, 9*b* to the valve assembly 16 through the first fluid line 17, and the one-way valve 19 blocks a flow of fluid from the valve assembly 16 to the hydraulic pumps/motors 9*a*, 9*b* through the first fluid line 17. Furthermore, the one-way valve 19 blocks a flow of fluid from the hydraulic pump 10 to the hydraulic machine 9 through the fluid line 17. And a solenoid controlled 2/2-way valve 20 selectively blocks a flow of fluid between the hydraulic machine 9 and the hydraulic displacement unit 1, more specifically between the hydraulic pumps/motors 9*a*, 9*b* and the valve assembly 16, through the second fluid line 18.

Figure 2:
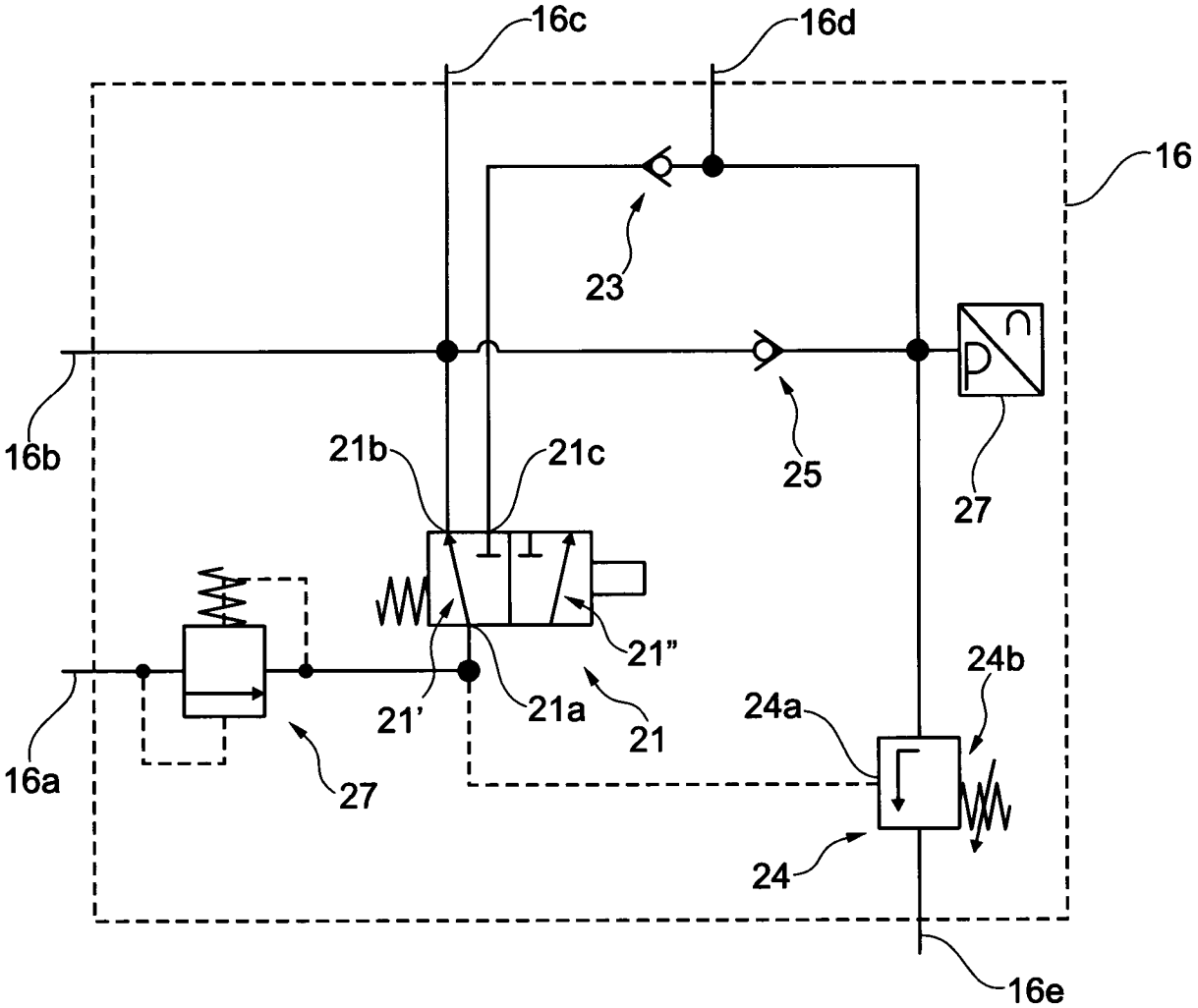
FIG. 2 schematically shows a detail of the hydraulic circuit of FIG. 1.

The valve assembly 16 schematically depicted in FIG. 1 and depicted in more detail in FIG. 2 has five fluid ports 16*a-e*. A first fluid port 16*a* of the valve assembly 16 is selectively fluidly connected with the hydraulic machine 9 through the first fluid line 17 and the one-way valve 19. Furthermore, the first fluid port 16*a* of the valve assembly 16 is selectively fluidly connected with the variable displacement hydraulic pump 10 through the one-way valve 26 and the 2/2-way valve 15. A second fluid port 16*b* of the valve assembly 16 is selectively fluidly connected with the hydraulic machine 9 through the second fluid line 18 and the 2/2-way valve 20. A third fluid port 16*c* of the valve assembly 16 is fluidly connected with the first fluid chamber 3 of the hydraulic displacement unit 1. A fourth fluid port 16*d* of the valve assembly 16 is fluidly connected with the second fluid chamber 4 of the hydraulic displacement unit 1. And a fifth fluid port 16*e* of the valve assembly 16 is fluidly connected with the low pressure fluid tank 14.

The first fluid chamber 3 of the hydraulic displacement unit 1 is fluidly connected with the second fluid line 18 through the fluid ports 16*b*, 16*c* of the valve assembly 16 (FIGS. 1 and 2). The second fluid chamber 4 of the hydraulic displacement unit 1 is selectively fluidly connected with the low pressure tank 14 via a pressure relief valve 24 and via the fluid ports 16*d*, 16*e* of the valve assembly 16. A hydraulic actuator 24*a* of the pressure relief valve 24 biasing the pressure relief valve 24 toward an open position is fluidly connected or selectively fluidly connected with the first fluid line 17 via an optional counterbalance valve 22 and the fluid port 16*a*. More specifically, the pressure relief valve 24 fluidly connects the second fluid chamber 4 of the hydraulic displacement unit 1 with the low pressure fluid tank 14 if a hydrostatic pressure in the first fluid line 17 exceeds a predetermined threshold pressure set by a spring 24*b*.

A one-way valve 25 (FIG. 2) selectively fluidly connects the second fluid chamber 4 of the hydraulic displacement unit 1 with the first fluid chamber 3 of the hydraulic displacement unit 1 and with the second fluid line 18 via the fluid ports 16*b*, 16*c*, 16*d*. The one-way valve 25 permits a flow of fluid from second fluid chamber 4 of the hydraulic displacement unit 1 to the first fluid chamber 3 of the hydraulic displacement unit 1 and to the second fluid line 18 through the one-way valve 25, and the one-way valve 25 blocks a flow of fluid from the first fluid chamber 3 of the hydraulic displacement unit 1 (and from the second fluid line 18) to the second fluid chamber 4 of the hydraulic displacement unit 1. The one-way valve 25 further blocks a flow of fluid from the first fluid chamber 3 of the hydraulic displacement unit 1 (and from the second fluid line 18) to the low pressure fluid tank 14 through the one-way valve 25.

A 3/2-way control valve 21 selectively fluidly connects the hydraulic machine 9 and/or the hydraulic pump 10 with either one of the first fluid chamber 3 and the second fluid chamber 4 of the hydraulic displacement unit 1 (FIGS. 1 and 2). The control valve 21 may be electromagnetically controlled, for example by means of a solenoid. The optional counterbalance valve 22 is fluidly disposed between the hydraulic machine 9 and/or the hydraulic pump 10 and the hydraulic displacement unit 1. The counterbalance valve 22 thus ensures that the hydraulic machine 9 and/or the hydraulic pump 10 may pressurize the hydraulic displacement unit 1 only if the pressure provided by the hydraulic machine 9 and/or the hydraulic pump 10 exceeds a predetermined threshold pressure.

When the control valve 21 is switched to the first control position 21', as shown in FIG. 2, the control valve 21 allows fluidly connecting the fixed displacement hydraulic machine 9 and/or the variable displacement hydraulic pump 10 with the first fluid chamber 3 of the hydraulic displacement unit 1 via the fluid ports 16*a*, 16*c* for pressurizing the first fluid chamber 3. That is, when the control valve 21 is switched to the first control position 21', the fixed displacement hydraulic machine 9 and/or the variable displacement hydraulic pump 10 may pressurize the first fluid chamber 3 of the hydraulic displacement unit 1. Furthermore, when the control valve 21 is switched to the first control position 21' and the hydraulic machine 9 and/or the hydraulic pump 10 pressurizes the first fluid chamber 3 of the hydraulic displacement unit 1 for lifting the piston 2 of the hydraulic displacement unit 1, fluid from the second fluid chamber 4 of the hydraulic displacement unit 1 may re-enter the first fluid chamber 3 of the hydraulic displacement unit 1 through the above-described one-way valve 25. At the same time, an optional one-way valve 23 may additionally prevent fluid leakage from the second fluid chamber 4 of the hydraulic displacement unit 1 to the control valve 21.

By contrast, when the control valve 21 is switched to the second control position 21" (not shown in FIG. 2), the control 21 allows fluidly connecting the fixed displacement hydraulic machine 9 and/or the variable displacement hydraulic pump 10 with the second fluid chamber 4 of the hydraulic displacement unit 1 via the fluid ports 16*a*, 16*d* for pressurizing the second fluid chamber 4.

A sensor 27 (FIG. 2) is fluidly connected with the second fluid chamber 4 of the hydraulic displacement unit 1 via the port 16*d*. The sensor 27 includes a pressure sensor and a flow sensor. That is, the sensor 27 is configured to measure a hydrostatic pressure in the second fluid chamber 4 of the hydraulic displacement unit 1 and a fluid flow through the hydraulic displacement unit 1.

It is understood that in alternative embodiments the sensor 27 may include only a pressure sensor or only a flow sensor. Furthermore, in alternative embodiments not explicitly depicted here, the sensor 27 may be fluidly connected with the first fluid chamber 3 of the hydraulic displacement unit 1 so that the sensor 27 may measure a fluid flow through the hydraulic displacement unit 1 and a hydrostatic pressure in the first fluid chamber 3. It is further conceivable that two sensors of the type of the sensor 27 are provided one of which is fluidly connected with the first fluid chamber 3 and one of which is fluidly connected with the second fluid chamber 4 of the hydraulic displacement unit.

The hydraulic circuit 100 further includes an electronic control unit 28 (FIG. 1). The control unit 28 may include one or more programmable microprocessors or one or more Field Programmable Gate Arrays (FPGAs), for example. Although FIG. 1 suggests that the control unit 28 is configured as a single integrated unit, it is understood that in alternative embodiments the control unit 28 may comprise a plurality of separate units which may be disposed at different locations in the hydraulic circuit 100. When the control unit 28 comprises a plurality of separate units, these separate units may be configured to communicate with one another.

The control unit 28 is configured or programmed to control the electric machine 7, in particular a rotational speed and/or a rotational power of the electric machine 7.

The control unit 28 is configured or programmed to control the electric motor 8, in particular a rotational speed and/or a rotational power of the electric motor 8. The control unit 28 is configured or programmed to control the hydraulic displacement of the hydraulic pump 10, for example by changing a swivel angle of a swashplate of the hydraulic pump 10. The control unit 28 is in communication with the sensor 27 and configured to receive measurement signals and/or measurement data from the sensor 27 (FIG. 2). And the control unit 28 is configured to control or switch the valves 15, 20, 21. For example, the control unit 28 may be configured to control at least one of or each of the electric machine 7, the electric motor 8, the hydraulic displacement of the hydraulic pump 10, and the valves 15, 20, 21 based on a command provided by an operator through an input device such as a touch pad, a switch, a pedal or a lever (not shown). The command provided by the operator may include a requested flow rate, for example. Additionally or alternatively, the control unit 28 may be configured to control at least one of or each of the electric machine 7, the electric motor 8, the hydraulic displacement of the hydraulic pump 10 and the valves 15, 20, 21 based on a measurement signal or based on measurement data provided by the sensor 27.

Figure 7:
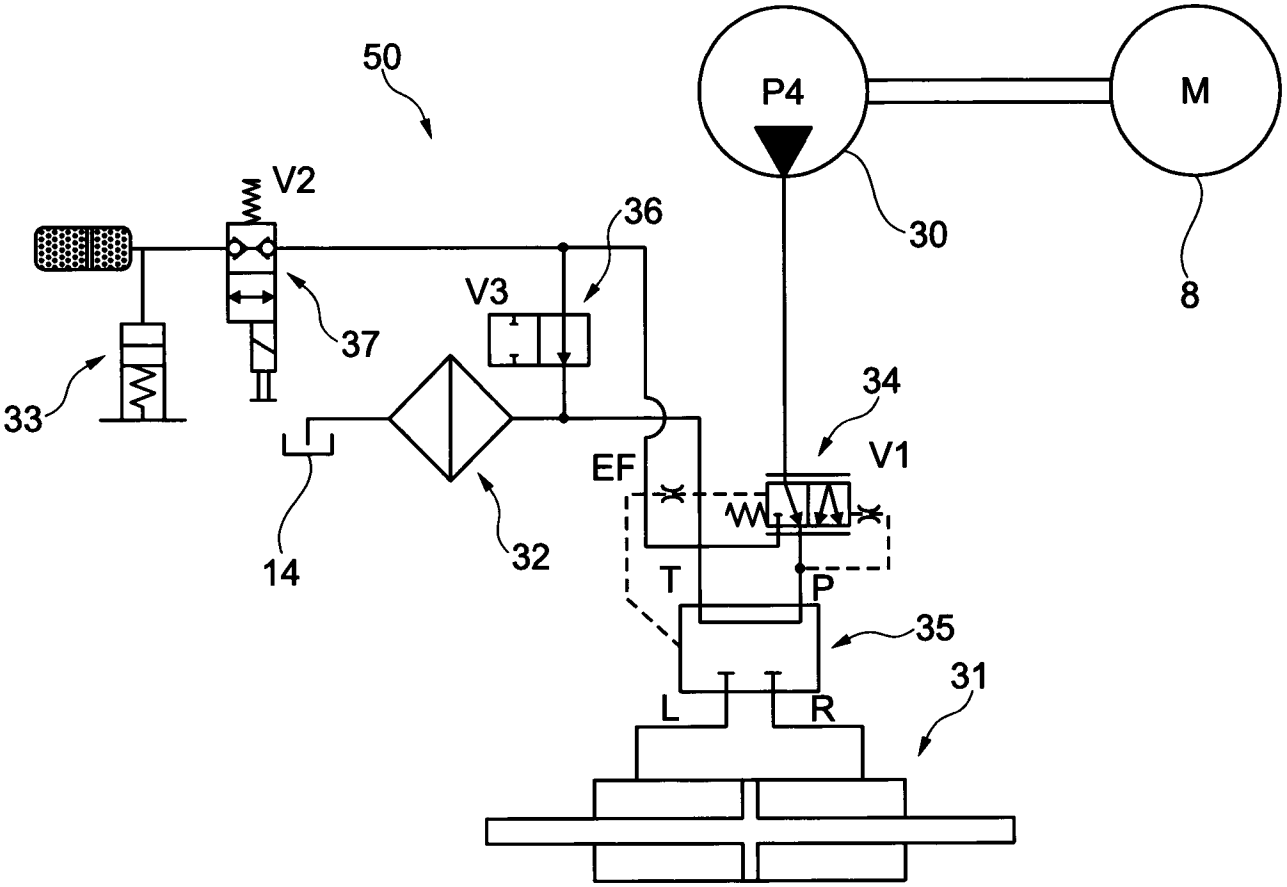
FIG. 7 schematically shows a further hydraulic circuit including a steering cylinder, a heat exchanger and a brake cylinder.
Figure 8:
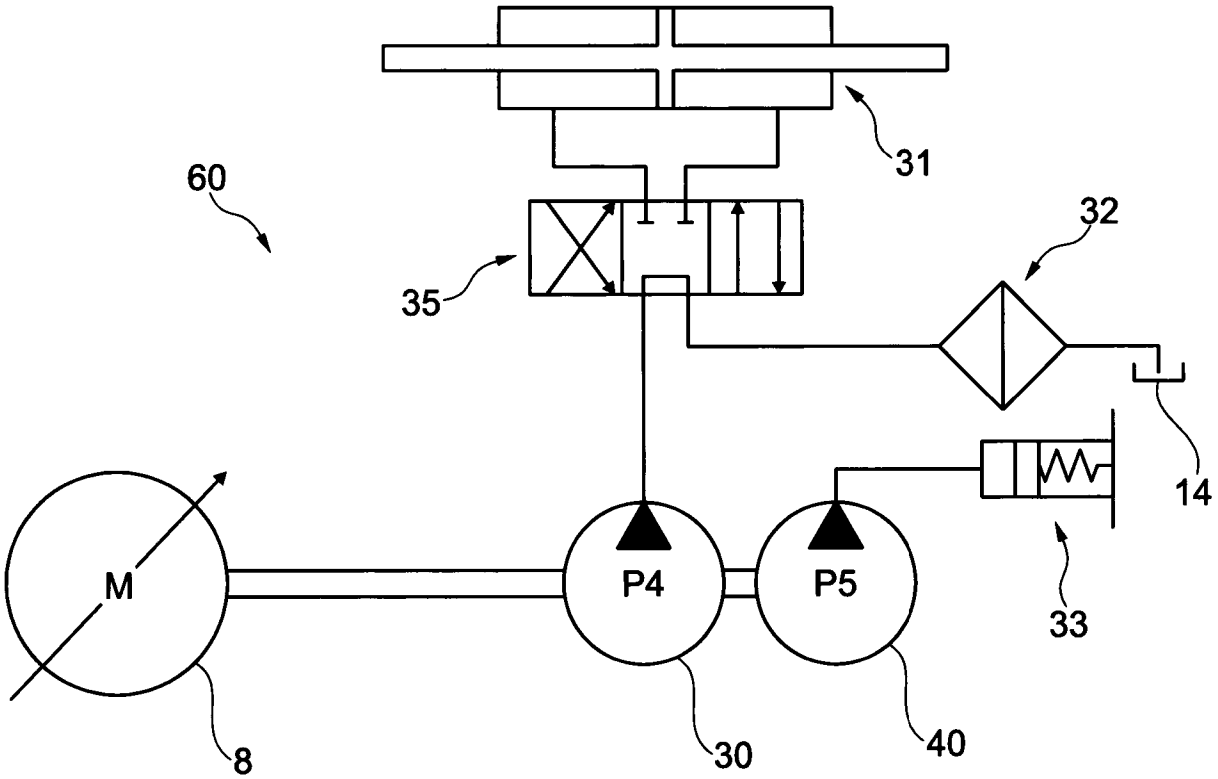
FIG. 8 schematically shows a variation of the hydraulic circuit of FIG. 7.

Optionally, the hydraulic circuit 100 may further comprise a hydraulic sub-circuit 50 including a hydraulic pump 30, a hydraulic steering cylinder 31, a heat exchanger 32, and a brake cylinder 33, wherein the hydraulic pump 30 may be drivingly engaged with the electric motor 8. The hydraulic sub-circuit 50 is shown in FIG. 7 and described in more detail below. Alternatively, the hydraulic sub-circuit 50 may be replaced by a hydraulic sub-circuit 60. The hydraulic sub-circuit 60 is shown in FIG. 8 and described in more detail below.

Figure 3A:
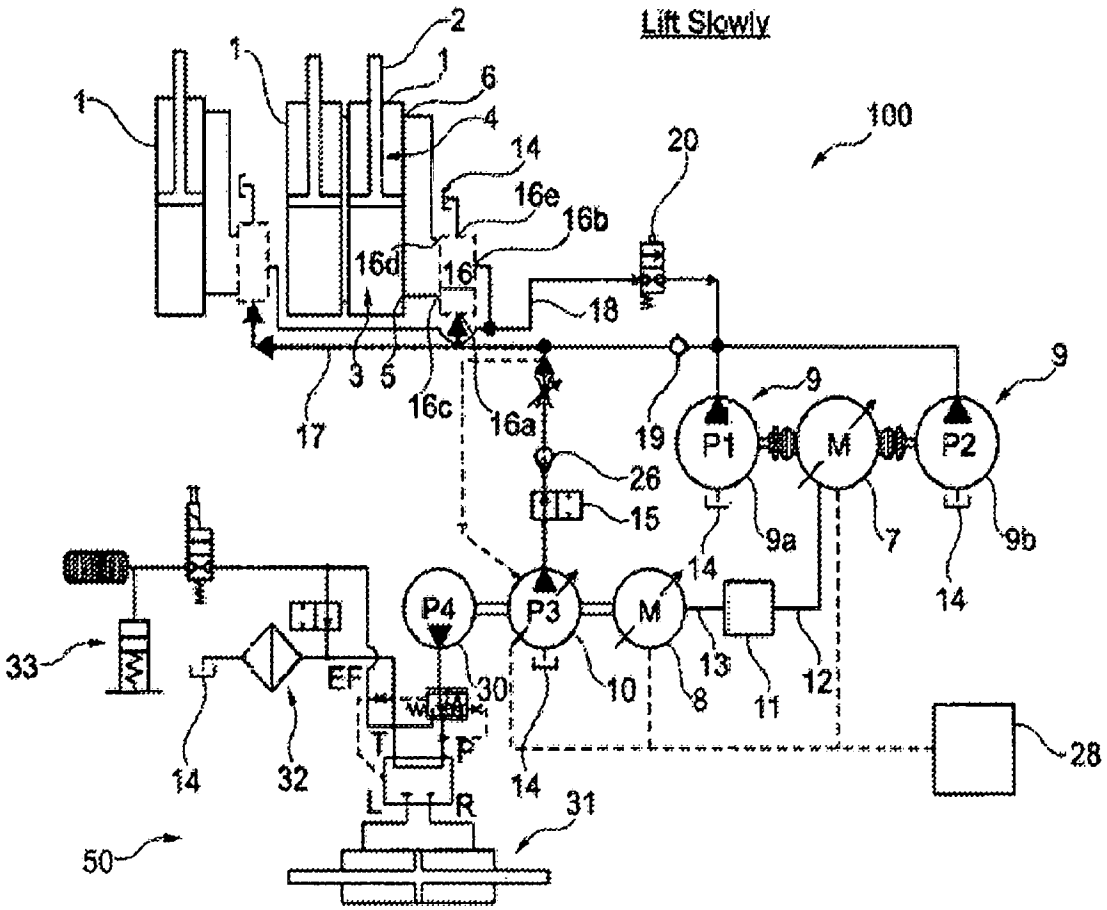
FIG. 3A schematically shows the hydraulic circuit of FIG. 1 during a first stage of a process of lifting a hydraulic piston.
Figure 3B:
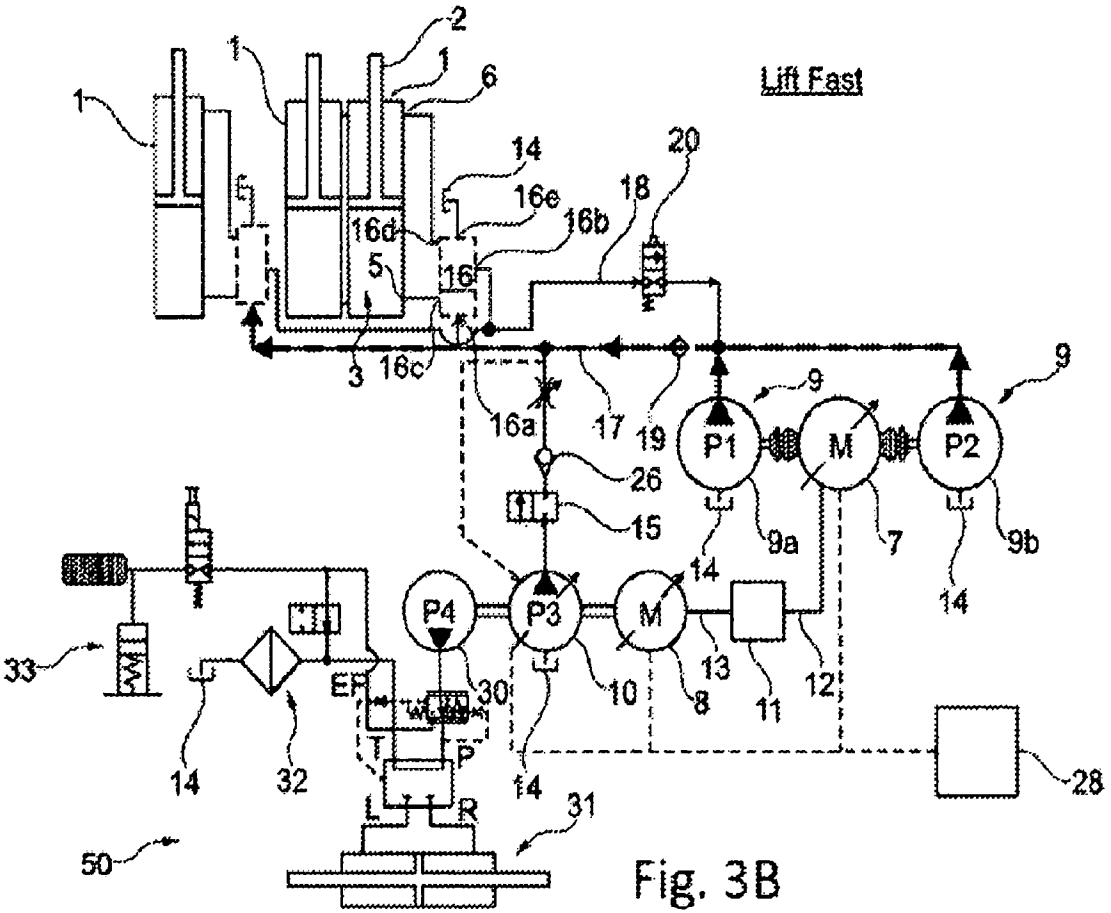
FIG. 3B schematically shows the hydraulic circuit of FIG. 1 during a second stage of the process of lifting the hydraulic piston.
Figure 4:
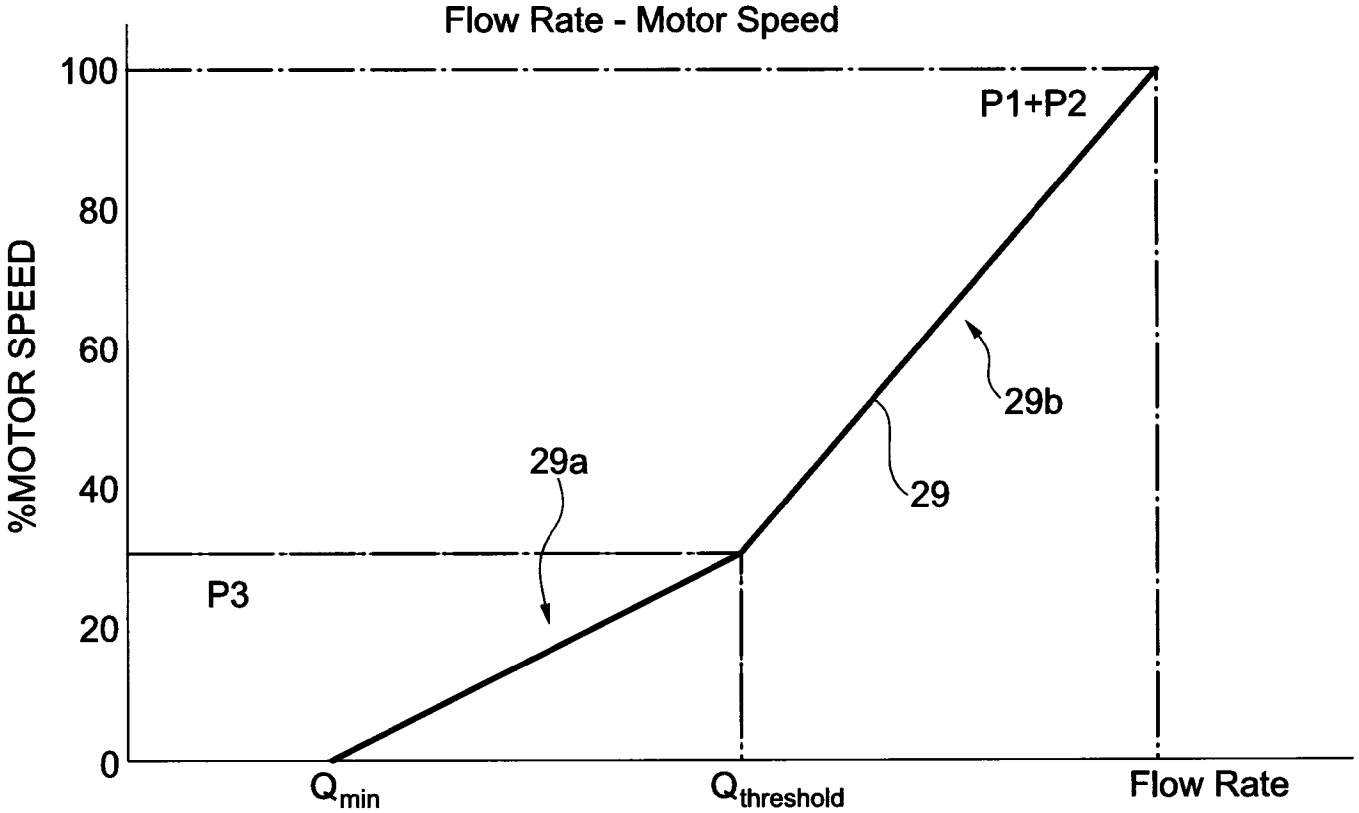
FIG. 4 schematically shows a graph depicting a motor speed versus a flow rate through a hydraulic displacement unit of the hydraulic circuit of FIG. 1.

FIG. 3A shows the hydraulic circuit 100 of FIG. 1 during a first stage of a process of lifting the piston 2 of the hydraulic displacement unit 1, and FIG. 3B shows the hydraulic circuit 100 of FIG. 1 during a second stage of the process of lifting the piston 2 of the hydraulic displacement unit 1. FIG. 4 includes a graph depicting a rotational speed of the electric motor 8 and of the electric machine 7 versus a flow rate Q. of fluid flowing through the hydraulic displacement unit 1 during the lifting process shown in FIGS. 3A and 3B. The lifting process is controlled by the control unit 28 and may be initiated by an input command provided by an operator of the hydraulic circuit 100, for example.

During the first stage of the lifting process depicted in FIG. 3A the control unit 28 at least initially halts the electric machine 7 so that the pumps 9*a*, 9*b* of the hydraulic machine 9 do not convey any fluid. Also, the control unit 28 closes the valve 20 or keeps the valve 20 closed, thereby blocking the second fluid line 18. At the same time, the control unit 28 opens the valve 15 and switches the control valve 21 (FIG. 2) to the first control position 2, thereby fluidly connecting the variable displacement hydraulic pump 10 with the first fluid chamber 3 of the hydraulic displacement unit 1 via the first fluid line 17 and the ports 16*a*, 16*c* of the valve assembly 16. Further, the control unit 28 sets the hydraulic displacement of the hydraulic pump 10 to a non zero value and gradually increases the speed of the electric motor 8 which is powered by the energy storage device 11.

Consequently, the electric motor 8 drives the variable displacement hydraulic pump 10 which conveys fluid from the low pressure fluid tank 14 to the first fluid chamber 3 of the hydraulic displacement unit 1 via the fluid line 17 and the counterbalance valve 22 which is forced to the open position (see the bold type dashed lines in FIG. 3A). In this way, the hydraulic pump 10 pressurizes the first fluid chamber 3 and lifts the piston 2 of the hydraulic displacement unit and a load disposed on the piston 2 upward. As the piston 2 is lifted upward in this manner, fluid forced out of the second fluid chamber 4 of the hydraulic displacement unit re-enters the first fluid chamber 3 of the hydraulic displacement unit 1 via the one-way valve 25 and the fluid ports 16*d*, 16*c* of the valve assembly 16. In this manner, only a minimum amount of fluid needs to be moved and only a minimum amount of energy needs to be expended to lift the piston 2. The one-way valve 19 prevents pressurized fluid conveyed by the hydraulic pump 10 from entering the hydraulic machine 9.

As the control unit 28 increases the speed of the electric motor 8 driving the variable displacement hydraulic pump 10 for lifting the piston 2, the control unit 28 may continuously control the hydraulic displacement of the hydraulic pump 10. For example, the control unit 28 may be configured to control the electric motor 8 and/or the hydraulic displacement of the hydraulic pump 10 in such a way that the fluid flow through the hydraulic displacement unit 1 follows a given time profile. For instance, the control unit 28 may be configured to control the electric motor 8 and/or the hydraulic displacement of the hydraulic pump 10 based on a measured flow date provided by the sensor 27 and/or based on a requested flow rate. For example, the control unit 28 may be configured to control the electric motor 8 and/or the hydraulic displacement of the hydraulic pump 10 using a feedback control algorithm. In this way, the flow rate provided by the electric motor 8 and by the hydraulic pump 10 for lifting the piston 2 may be precisely controlled even at low flow rate values.

In FIG. 4 the first stage of the lifting process during which the hydraulic displacement unit 1 is pressurized by the hydraulic pump 10 is described by a section 29*a* of the motor speed-vs-flow rate curve 29. Starting from a minimum flow rate $Q_{min}$ the flow rate provided by the hydraulic pump 10 gradually increases as the speed of the electric motor 8 increases.

Once an actual flow rate through the hydraulic displacement unit 1 measured by the sensor 27 reaches or exceeds a threshold value $Q_{threshold}$, the control unit 28 initiates the second stage of the lifting process which is depicted in FIG. 3B. The threshold flow rate $Q_{threshold}$ may have a fixed and predetermined value or may be determined by the control unit 28 based on parameters such as the requested flow rate, for example. As the actual flow rate reaches the threshold value $Q_{threshold}$, the control unit 28 halts the electric motor 8 so that the electric motor 8 stops driving the variable displacement hydraulic pump 10. Also, the control unit 28 closes the valve 15. The control valve 21 (FIG. 1) remains in the first control position 2. The control unit 28 then turns on the electric machine 7, thereby operating the electric machine 7 as an electric motor powered by the energy storage device 11. Alternatively, it is conceivable that as the lifting process shifts from the first stage to the second stage, the control unit 28 drives the electric motor 8 and the electric machine 7 simultaneously at least for a limited period of time, for example in order to minimize discontinuities in the flow rate through the hydraulic displacement unit 1.

During the second stage of the lifting process, the electric machine 7 drives the hydraulic pumps 9*a*, 9*b* of the hydraulic machine 9 which convey fluid from the low pressure fluid tank 14 to the first fluid chamber 3 of the hydraulic displacement unit 1 via the first fluid line 17 and the counterbalance valve 22 which remains forced to the open position (see the bold type dashed lines in FIG. 3B). In FIG. 3B the control unit 28 operates the electric machine 7 and the hydraulic machine 9 in a drive mode. In this way, the hydraulic machine 9 pressurizes the first fluid chamber 3 and lifts the piston 2 of the hydraulic displacement unit 1 and the load disposed thereon further upward. Again, fluid forced out of the second fluid chamber 4 of the hydraulic displacement unit re-enters the first fluid chamber 3 of the hydraulic displacement unit 1 via the one-way valve 25 and the fluid ports 16*d*, 16*c* of the valve assembly 16.

In FIG. 4, the second stage of the lifting process during which the hydraulic displacement unit 1 is pressurized by the hydraulic machine 9 is described by a section 29*b* of the motor speed-vs-flow rate curve 29. Starting from a threshold flow rate $Q_{threshold}$ the flow rate provided by the hydraulic machine 9 further increases as the speed of the electric machine 7 is further raised. As the fixed hydraulic displacement of the hydraulic machine 9 differs from the hydraulic displacement of the hydraulic pump 10 employed during the first stage of the lifting process, a slope of the curve 29 in the first section 29*a* corresponding to the first stage of the lifting process differs from a slope of the curve 29 in the second section 29*b* corresponding to the second stage of the lifting process.

Figure 5:
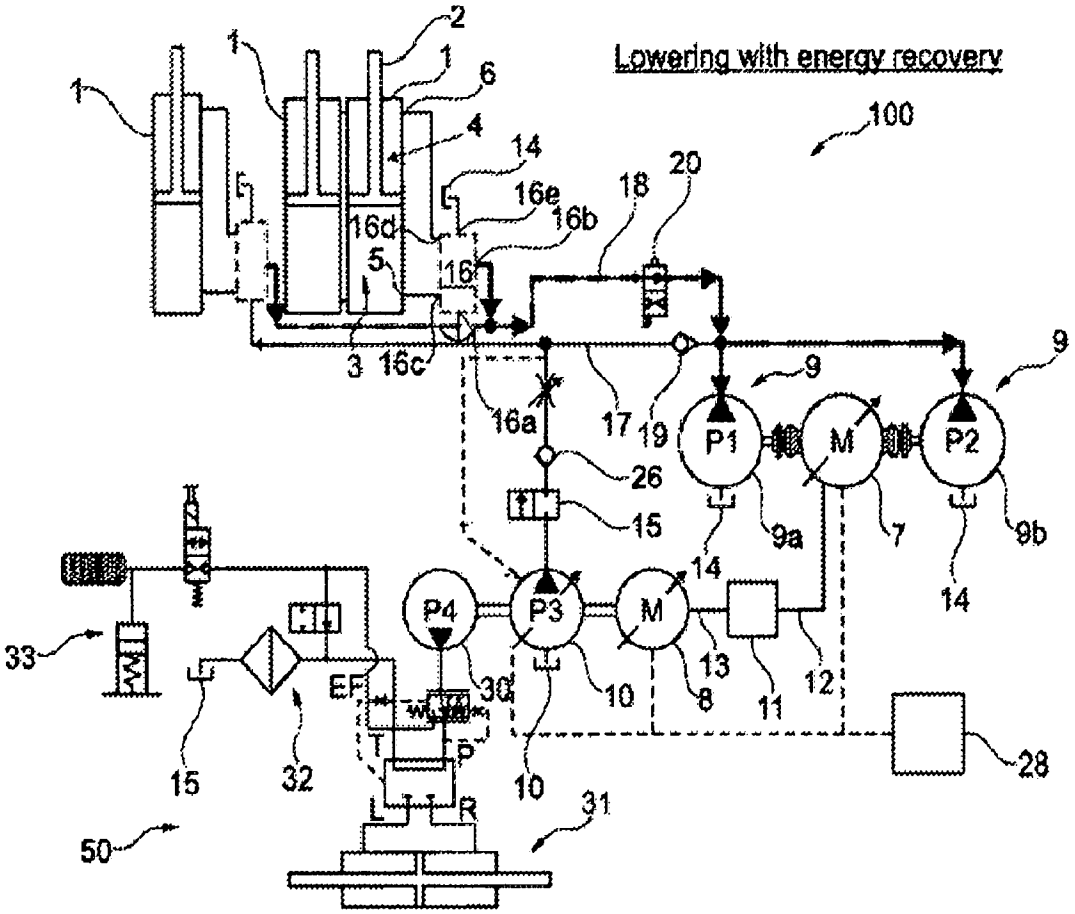
FIG. 5 schematically shows the hydraulic circuit of FIG. 1 during a process of lowering the hydraulic piston and of recuperating energy from or through the hydraulic piston.

FIG. 5 depicts the hydraulic circuit 100 of FIGS. 1-3 during a process of lowering the piston 2 of the hydraulic displacement unit 1 and of a load supported thereon. In FIG. 5, the control unit 28 opens the valve 20, thereby fluidly connecting the first fluid chamber 3 of the hydraulic displacement unit 1 with the hydraulic machine 9 via the ports 16*c*, 16*b* of the valve assembly 16 (FIG. 2) and via second fluid line 18. The weight of the load supported on the piston 2 forces the piston 2 to displace fluid from the first fluid chamber 3 of the hydraulic displacement unit 1 to the low pressure fluid tank 14 through the pumps/motors 9*a*, 9*b* of the hydraulic machine 9, thereby driving the hydraulic machine 9. The hydraulic machine 9 in turn drives the electric machine 7 which is operated as an electrical generator and recharges the rechargeable energy storage device 11. In this manner, during the lowering process the potential energy of the load supported on the piston 2 may be at least partially recuperated by the hydraulic machine 9 and the electric machine 7 and stored in the rechargeable energy storage device 11.

As the piston 2 is lowered and displaces fluid out of the first fluid chamber 3 of the hydraulic displacement unit 1, fluid may enter the second fluid chamber 4 of the hydraulic displacement unit 1 via an additional fluid connection between the second fluid chamber 4 and the low pressure fluid tank 14 (not shown). For example, the second fluid chamber 4 and the low pressure fluid tank 14 may be selectively fluidly connected via an additional one-way valve (not shown) that allows fluid from the low pressure fluid tank 14 to be drawn into the second fluid chamber 4, and that blocks a flow of fluid from the second fluid chamber 4 to the fluid tank 14 through this additional one-way valve.

Alternatively, the hydraulic pump 10 may convey fluid from the low pressure fluid tank 14 to the second fluid chamber 4 of the hydraulic displacement unit 1 during the lowering process. To that end, the control unit 28 may open the valve 15 and switch the control valve 21 to the second control position 21", thereby fluidly connecting the hydraulic pump 10 with the second fluid chamber 4 of the hydraulic displacement unit 1 via the first fluid line 17, the counterbalance valve 22, the one way valve 23, and the ports 16*a*, 16*d* of the valve assembly 16 (FIG. 2).

Figure 6:
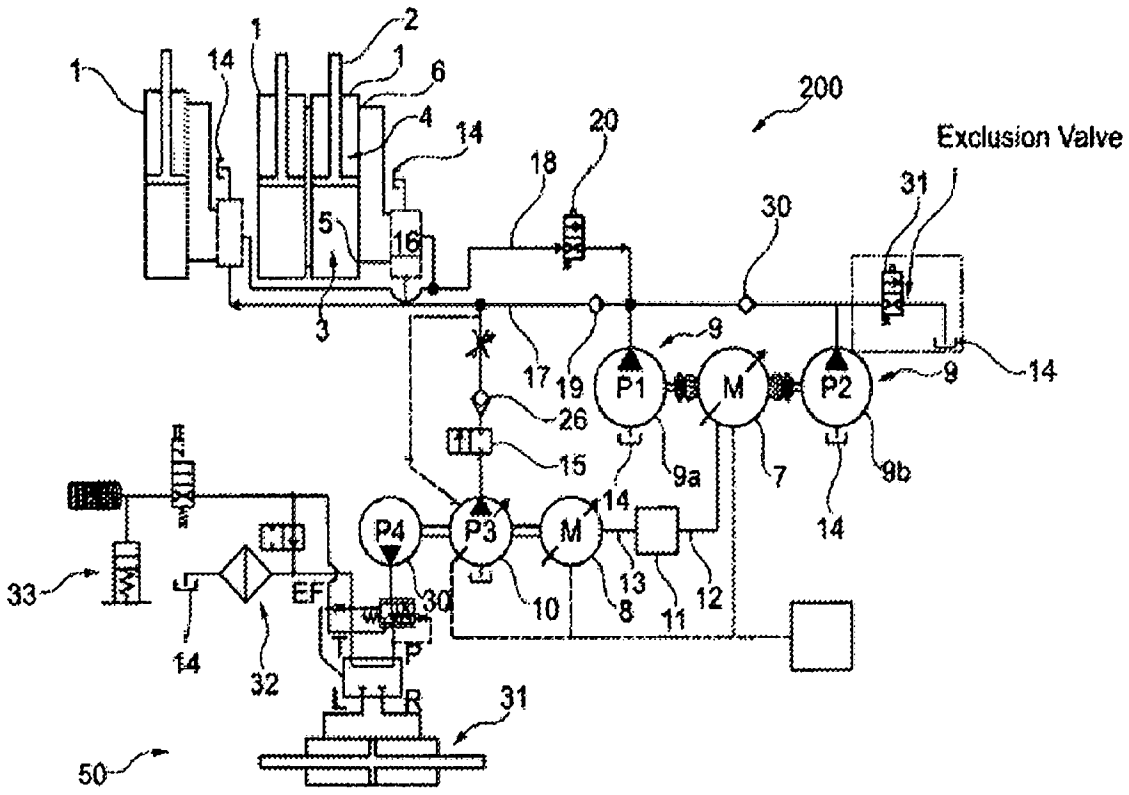
FIG. 6 schematically shows the presently proposed hydraulic circuit according to a second embodiment.

FIG. 6 shows a hydraulic circuit 200 which is a slight modification of the hydraulic circuit 100 of FIG. 1. The hydraulic circuit 200 of FIG. 6 differs from the hydraulic circuit 100 of FIG. 1 only in that it includes an additional one-way valve 62 and an additional 2/2-way valve 64 which may be used to divert flow from the pump/motor 9*b* of the hydraulic machine 9 directly into the low pressure fluid tank 14. Using only the pump/motor 9*a* of the hydraulic machine 9 may increase the efficiency of the hydraulic circuit 200 under certain conditions, for example at high rotational speeds of the pump/motor 9*a*.

FIG. 7 shows a hydraulic circuit 50. The hydraulic circuit 50 may be disposed in or on an automotive vehicle, for example in or on an off-highway vehicle such as a loader, a dumper, a forklift truck, a tractor, or the like. The hydraulic circuit 50 of FIG. 7 may be part of the hydraulic circuit 100, as indicated in FIG. 1 and in FIGS. 3-6. However, the hydraulic circuit 50 may likewise be independent of the hydraulic circuit 100 of FIG. 1.

The hydraulic circuit 50 includes an electric motor 8 and a hydraulic pump 30 drivingly engaged with the electric motor. When the hydraulic circuit 50 is integrated in or is part of the hydraulic circuit 100 of FIG. 1, the hydraulic circuit 50 and the hydraulic circuit 100 may share the electric motor 8 of FIG. 1 such that both the hydraulic pump 10 of the hydraulic circuit 100 of FIG. 1 and the hydraulic pump 30 of the hydraulic circuit 50 of FIG. 7 are drivingly engaged with the electric motor 8. The hydraulic pump 30 may have a fixed hydraulic displacement, for example. The hydraulic circuit 50 further includes a hydraulic steering cylinder 31, a heat exchanger 32 such as a cooler, for example a cooler for cooling a lubrication system, and a brake cylinder 33. The steering cylinder 31, the heat exchanger 32 and the brake cylinder 33 are fluidly connected or selectively fluidly connected with the hydraulic pump 30 through valves 34, 35, 36, 37 so that the hydraulic pump 30 may selectively pressurize at least one of or all of the steering cylinder 31, the heat exchanger 32 and the brake cylinder 33. The valves 34-37 may be electromagnetically controlled. An outlet of the heat exchanger 32 is furthermore fluidly connected with a low pressure fluid tank 14. The electric motor 8 may be powered by an energy storage device such as the energy storage device 11 shown in FIG. 1.

The electric motor 8 and the valves 34-37 may be in communication with a control unit such as the control unit 28 shown in FIG. 1. That is, the control unit may be configured to control the electric motor 8, in particular a rotational speed of the electric motor 8 and/or a power of the electric motor 8. And the control unit may be configured to control the valves 34-37 for selectively pressurizing at least one of or all of the steering cylinder 31, the heat exchanger 32 and the brake cylinder 33. FIG. 8 shows a hydraulic circuit 60 which is a variation of the hydraulic circuit 50 of FIG. 7. The hydraulic circuit 60 of FIG. 8 differs from the hydraulic circuit 50 of FIG. 7 in that the hydraulic circuit 60 of FIG. 8 includes a further hydraulic pump 40 drivingly engaged with the electric motor 8 and fluidly connected with the brake cylinder 33. And the hydraulic circuit 60 of FIG. 8 further differs from the hydraulic circuit 50 of FIG. 7 in that the hydraulic pump 30 is selectively fluidly connected only with the steering cylinder 31 and with the heat exchanger 32 via the valve 35 so that the hydraulic pump 30 of the hydraulic circuit 60 may be selectively fluidly connected with one of the steering cylinder 31 and the heat exchanger 32.

The invention claimed is:

1. A hydraulic circuit, comprising:

a hydraulic displacement unit for driving an implement;

a hydraulic machine fluidly connected or selectively fluidly connected with the hydraulic displacement unit, the hydraulic machine having a fixed hydraulic displacement;

an electric machine drivingly engaged or selectively drivingly engaged with the hydraulic machine;

a hydraulic pump fluidly connected or selectively fluidly connected with the hydraulic displacement unit, the hydraulic pump having a variable hydraulic displacement;

an electric motor drivingly engaged or selectively drivingly engaged with the hydraulic pump; and a control unit configured to control the electric machine and the electric motor based at least on a requested flow rate through the hydraulic displacement unit and based on a threshold flow rate through the hydraulic displacement unit; wherein when the requested flow rate is below the threshold flow rate, the control unit is configured to halt the electric machine and to drive the hydraulic displacement unit via the electric motor and the hydraulic pump.

2. The hydraulic circuit of claim 1, wherein when the requested flow rate is equal to or above the threshold flow rate, the control unit is configured to halt the electric machine and to drive the hydraulic displacement unit via the electric motor and the hydraulic pump at least as long as an actual flow rate through the hydraulic displacement unit is below the threshold flow rate, and to drive the hydraulic displacement unit via the electric machine and the hydraulic machine when or once the actual flow rate exceeds the threshold flow rate.

3. The hydraulic circuit of claim 2, wherein when or once the actual flow rate exceeds the threshold flow rate, the control unit is configured to halt the electric motor.

4. The hydraulic circuit of claim 1, wherein the control unit is configured to control the hydraulic displacement of the hydraulic pump based at least on one of the requested flow rate and an actual flow rate through the hydraulic displacement unit.

5. The hydraulic circuit of claim 1, further comprising an energy storage device electrically connected to the electric machine, the electric machine and the hydraulic machine configured to be operated in a drive mode for driving the hydraulic displacement unit, wherein in the drive mode the electric machine is operated as an electric motor converting energy stored in the energy storage device into mechanical energy for driving the hydraulic machine, and the hydraulic machine is operated as a hydraulic pump for pressurizing the hydraulic displacement unit.

6. The hydraulic circuit of claim 5, wherein the energy storage device comprises an accumulator, the electric machine and the hydraulic machine configured to be operated in a recuperation mode for recuperating energy from or via the hydraulic displacement unit, wherein in the recuperation mode the hydraulic machine is operated as a hydraulic motor for driving the electric machine, and the electric machine is operated as a generator for charging the energy storage device.

7. The hydraulic circuit of claim 5, wherein the energy storage device is electrically connected to the electric motor for driving the electric motor.

8. The hydraulic circuit of claim 1, wherein the hydraulic displacement unit comprises a first fluid port and a second fluid port, wherein the hydraulic machine is selectively fluidly connected with the first fluid port of the hydraulic displacement unit.

9. The hydraulic circuit of claim 8, wherein the hydraulic machine is selectively fluidly connected with the first fluid port of the hydraulic displacement unit via either one of:

a first fluid line for pressurizing the hydraulic displacement unit via the first fluid line, and a second fluid line for recuperating energy from or via the hydraulic displacement unit via the second fluid line.

10. The hydraulic circuit of claim 9, further comprising a first valve for selectively blocking a flow of fluid between the hydraulic machine and the hydraulic displacement unit through the first fluid line, and further comprising a second valve for selectively blocking a flow of fluid between the hydraulic machine and the hydraulic displacement unit through the second fluid line.

11. The hydraulic circuit of claim 9, wherein the hydraulic pump is selectively fluidly connected with the first and the second fluid port of the hydraulic displacement unit via a control valve, the control valve comprising at least:

a first fluid port fluidly connected or selectively fluidly connected with the hydraulic pump and with the hydraulic machine;

a second fluid port fluidly connected with the first fluid port of the hydraulic displacement unit and with the hydraulic machine, in particular through the second fluid line; and a third fluid port fluidly connected with the second fluid port of the hydraulic displacement unit, wherein the control valve comprises:

a first control position in which the first fluid port of the control valve is fluidly connected with the second fluid port of the control valve and fluidly isolated from the third fluid port of the control valve; and a second control position in which the first fluid port of the control valve is fluidly connected with the third fluid port of the control valve and fluidly isolated from the second fluid port of the control valve.

12. The hydraulic circuit of claim 11, wherein the first fluid port is fluidly connected or selectively fluidly connected with the hydraulic pump and the hydraulic machine through the first fluid line.

13. The hydraulic circuit of claim 8, wherein the hydraulic pump is selectively fluidly connected with either one of the first fluid port of the hydraulic displacement unit and the second fluid port of the hydraulic displacement unit.

14. The hydraulic circuit of claim 8, wherein the first fluid port of the hydraulic displacement unit and the second fluid port of the hydraulic displacement unit are in selective fluid communication with one another via a one-way valve, the one-way valve configured to permit a flow of fluid from the second fluid port of the hydraulic displacement unit to the first fluid port of the hydraulic displacement unit through the one-way valve, and the one-way valve configured to block a flow of fluid from the first fluid port of the hydraulic displacement unit to the second fluid port of the hydraulic displacement unit through the one-way valve.

15. A hydraulic circuit, comprising:

a hydraulic displacement unit for driving an implement;

a hydraulic machine fluidly connected or selectively fluidly connected with the hydraulic displacement unit, the hydraulic machine having a fixed hydraulic displacement;

an electric machine drivingly engaged or selectively drivingly engaged with the hydraulic machine;

a hydraulic pump fluidly connected or selectively fluidly connected with the hydraulic displacement unit, the hydraulic pump having a variable hydraulic displacement;

an electric motor drivingly engaged or selectively drivingly engaged with the hydraulic pump;

at least one steering cylinder;

at least one brake cylinder;

at least one heat exchanger; and a further hydraulic pump drivingly engaged or selectively drivingly engaged with the electric motor;

wherein the further hydraulic pump is fluidly connected or selectively fluidly connected with the at least one steering cylinder, with the at least one brake cylinder, and with the at least one heat exchanger.

16. The hydraulic circuit of claim 15, wherein the at least one heat exchanger is a cooler for cooling a lubrication system.

* * * * *